US005840456A

United States Patent [19]

Tomita et al.

[11] Patent Number: 5,840,456

[45] Date of Patent: Nov. 24, 1998

[54] COLOR TONER COMPRISING TWO BINDER RESINS OF DIFFERING SOFTENING POINT

[75] Inventors: Masami Tomita; Hiroshi Yaguchi; Yasuo Asahina; Yasuaki Iwamoto, all of Numazu; Satoru Miyamoto, Mishima; Tomomi Suzuki, Gotenba, all of Japan

[73] Assignee: Ricoh Company, Ltd., Tokyo, Japan

[21] Appl. No.: 689,368

[22] Filed: Aug. 8, 1996

[30] Foreign Application Priority Data

Aug. 8, 1995 [JP] Japan ..... 7-222708
Aug. 2, 1996 [JP] Japan ..... 8-220324

[51] Int. Cl.[6] ..... G03G 9/087

[52] U.S. Cl. ..... 430/106; 430/110

[58] Field of Search ..... 430/106, 109, 430/110, 111

[56] References Cited

U.S. PATENT DOCUMENTS

| | | | |
|---|---|---|---|
| 5,652,075 | 7/1997 | Kanbayashi et al. | 430/109 |
| 5,658,991 | 8/1997 | Kosaka et al. | 430/109 |
| 5,659,857 | 8/1997 | Yamazaki et al. | 430/109 |
| 5,660,964 | 8/1997 | Machida et al. | 430/110 |

*Primary Examiner*—John Goodrow
*Attorney, Agent, or Firm*—Oblon, Spivak, McClelland, Maier & Neustadt, P.C.

[57] ABSTRACT

A color toner includes a binder resin composition comprising a binder resin A with a softening point in the range of 85° to 110° C., and a binder resin B with a softening point in the range of 115° to 135° C., with the binder resin A and the binder resin B being compatible with each other; a coloring agent; and a wax with a melting point in the range of 65° to 90° C., which is not compatible with the binder resin composition and dispersed in the binder resin composition.

15 Claims, No Drawings

COLOR TONER COMPRISING TWO BINDER RESINS OF DIFFERING SOFTENING POINT

BACKGROUND OF THE INVENTION

1. Field of the Invention

The present invention relates to a color toner for developing latent electrostatic images formed by electrophotography, electrostatic recording or the like, more particularly to a color toner which can be fixed on a toner-image-bearing member by an image-fixing device comprising an image fixing roller without requiring the application of any oil to the image fixing roller.

2. Discussion of Background

Recently, in the field of hard copies made by electrophotography, black-and-white hard copies are now rapidly being replaced by full-color hard copies, and the market for full-color hard copies is now expanding.

In color image formation by full-color electrophotography, all colors are reproduced by using the three primary colors, that is, yellow, magenta and cyan, or four colors with the addition of black to the three primary colors.

The color image formation is generally conducted as follows. The light reflected by an original document is projected onto a photoconductive layer of a photoconductor through a color separation optical transmission filter which is in the relationship of complementary colors with the toner colors, whereby a latent electrostatic image is formed on the photoconductive layer. The latent electrostatic image thus formed is developed with a color toner, and a toner image is transferred to a toner-image-bearing member. Such a development and image-transfer process is repeated by use of other color toners to form a full-color image in such a manner that a plurality of color toners is superimposed on the identical toner-image-bearing member, with the adjustment of the registration. The thus obtained full-color images are then fixed on the toner-image-bearing member by only one time image-fixing operation.

The full-color electrophotography requires a plurality of development steps and one time image fixing step for fixing several superimposed toner images with different colors to an identical image-bearing member, so that the fixing characteristics of each color toner is one of the most important factors for conducting the full-color electrophotography. To be more specific, each color toner fixed on the toner-image-bearing member is required to have appropriate glossiness and luster with a minimum irregular reflection by the toner particles of the toner. Furthermore, each color toner is required to have such transparency that other color toners with different colors deposited under the toner are made visible without changing the respective color tones. Namely, a color toner with a broad-range color reproduction performance is required.

In an image fixing device for fixing color toners onto a toner-image-bearing member, there is employed an image-fixing roller, which is made of a material having good surface releasability, but in most cases, an oil is also applied to the surface of the image-fixing roller to improve the surface releasability.

However, when a large quantity of oil is applied to the surface of the image-fixing roller, for instance, the following problems are caused: A transfer sheet is stained with the oil, the cost for image fixing is increased, and a large space for a container for holding the oil is required within the image fixing device, so that the size of the image-fixing device has to be increased.

However, an oil is still applied to the image-fixing roller for fixing the color toner to the toner-image-bearing member. The reasons therefor are as follows:

Generally, a color toner, when heated for image fixing, is required to more readily increase thermal fusibility and decrease the viscosity thereof in order to obtain proper glossiness and transparency, in comparison with a black toner for use in black-and-white image prints.

A color toner which comprises a resin having the above-mentioned thermal characteristics tends to increase the adhesion to a heated image fixing roller when passing in contact with the image fixing roller because of the tendency of decreasing the intermolecular cohesion of the resin when fused. Thus, the color toner in fact adheres to the image-fixing roller during the image fixing step, whereby the so-called high-temperature offset phenomenon is caused to occur. To prevent the occurrence of the high-temperature offset phenomenon, an oil is generally applied to the surface of the image-fixing roller to reduce the adhesion of the color toner to the image-fixing roller.

As an alternative image fixing method, a method of using an oil-less toner has been proposed in which the previously mentioned oil is not applied to the image-fixing roller. As such an oil-less toner, toners with a wax dispersed therein are generally proposed. However, when such an oil-less toner is used as a color toner, the wax has to be caused to ooze sufficiently from the surface of the toner particles of the color toner which is heated with a decreased viscosity for image fixing. In this case, however, it is extremely difficult to prevent the offset phenomenon from occurring.

On the other hand, when the color toner has high viscosity as in the case of a black toner for the formation of black-and-white hard copies, the offset phenomenon can be prevented due to a small oozing amount of the wax, since the intermolecular cohesion of a resin used in such a color toner is small. However, such a color toner cannot be sufficiently fused and does not exhibit sufficient glossiness and luster when fixed.

Varieties of color toners comprising as the binder resin particular polyester resins have been proposed, for example, in Japanese Patent Publication 8-12475 and Japanese Laid-Open Patent Applications 5-158282 and 7-333903. These color toners, however, have the problems that the offset phenomenon cannot be effectively prevented when no oil is applied to the image-fixing roller, so that a small amount of oil has to be applied to the image-fixing roller.

Japanese Laid-Open Patent Application 5-158281 discloses a toner which uses a dispersing liquid of a binder resin, with a specific transparency. The anti-offset performance of this toner, however, is insufficient for use in practice, when no oil is used.

Japanese Laid-Open Patent Application 51-144625 discloses a magenta toner comprising a particular polyester resin to which a particular silicone varnish and a pigment are added; and Japanese Laid-Open Patent Application 7-333904 discloses a toner comprising a particular polyester resin and a wax, with the respective refractive indexes thereof being limited. These toners, however, have the shortcoming that images with high glossiness are difficult to obtain by the toners.

Japanese Laid-Open Patent Application 7-219274 discloses a color toner comprising a pigment-dispersed resin which contains a polyolefin wax, and a binder resin, with the difference in SP value between the binder resin and the pigment-dispersed resin being limited; and Japanese Laid-Open Patent Application 7-311479 discloses an image fixing roller with a surface layer thereof being provided with an elastic layer which is coated with a fluoroplastic, which image fixing roller is for use with the color toner disclosed in the above-mentioned Japanese Laid-Open Patent Application 7-219274. The color toner disclosed in Japanese Laid-Open Patent Application 7-219274 contains a polyolefin wax, but is not sufficiently effective for use as an oil-less toner.

Japanese Laid-Open Patent Application 8-50367 and 8-50368 also disclose toners, each of which contains an ester wax with particular properties. These toners, however, are unsatisfactory as oil-less toners for use in practice.

Thus, there has not yet been obtained a color toner which can be used in an image fixing device without using any oil, and is capable of exhibiting sufficient anti-offset performance, glossiness and transparency for use in practice.

SUMMARY OF THE INVENTION

It is therefore an object of the present invention to provide full-color toners, which are capable of exhibiting excellent image fixing performance, high glossiness and transparency, and are free from the high temperature offset phenomenon, even when no oil is applied to an image fixing roller therefor.

The above object of the present invention can be achieved by a color toner which comprises a binder resin composition comprising a binder resin A with a softening point in the range of 85° to 110° C., and a binder resin B with a softening point in the range of 115° to 135° C., the binder resin A and the binder resin B being compatible with each other; a coloring agent; and a wax with a melting point in the range of 65° to 90° C., which is not compatible with the binder resin composition and dispersed in the binder resin composition.

In the above color toner, each of the binder resin A and the binder resin B may have a main peak in the range of 3.5 to 4.5 in terms of the logarithmic molecular weight LogM thereof in the molecular weight distribution thereof.

Furthermore, in the above color toner, each of the binder resin A and the binder resin B may comprise a polyester resin or a polyol resin.

As such a polyester resin, it is preferable to use a polyester resin which can be obtained by condensation polymerization of:

(a) a diol component of formula (I):

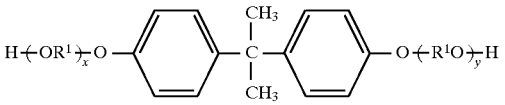

(I)

wherein $R^1$ is an alkylene group having 2 to 4 carbon atoms; and x and y represent a positive integer, with the total sum of x and y having an average value of 2 to 16; and (b) at least one acid component selected from the group consisting of:

(1) a dicarboxylic acid represented by formula (II)

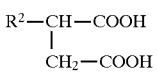

(II)

wherein $R^2$ is a saturated or unsaturated hydrocarbon group having 4 to 20 carbon atoms;

(2) an anhydride of the dicarboxylic acid of formula (II);

(3) a lower alkyl ester of the dicarboxylic acid of formula (II);

(4) a dicarboxylic acid represented by formula (III)

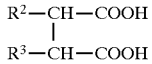

(III)

wherein $R^2$ and $R^3$ are a saturated or unsaturated hydrocarbon group having 4 to 20 carbon atoms;

(5) an anhydride of the dicarboxylic acid of formula (III);

(6) a lower alkyl ester of the dicarboxylic acid of formula (III);

(7) an aromatic polycarboxylic acid represented by formula (IV):

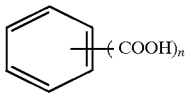

(IV)

wherein n is an integer of 2 to 3;

(8) a lower alkyl ester of the aromatic polycarboxylic acid of formula (IV); and (9) an anhydride of the aromatic polycarboxylic acid of formula (IV).

Furthermore, it is preferable that the wax for use in the present invention have a Mw/Mn ratio of 1.0 to 1.2 and be selected from the group consisting of an ester wax and an olefin wax.

DESCRIPTION OF THE PREFERRED EMBODIMENTS

The color toner according to the present invention comprises a binder resin composition comprising a binder resin A with a softening point in the range of 85° to 110° C., and a binder resin B with a softening point in the range of 115° to 135° C., the binder resin A and the binder resin B being compatible with each other; a coloring agent; and a wax with a melting point in the range of 65° to 90° C., which is not compatible with the binder resin composition and dispersed in the binder resin composition.

When the above color toner is employed in electrophotography for producing color images, using a pressure application type image fixing device comprising a heat application image fixing roller, it is possible to obtain sufficient anti-offset performance for use in practice, without application of an oil to the image fixing roller.

To be more specific, the binder resin composition for use in the color toner of the present invention comprises a binder resin A with a softening point in the range of 85° to 110° C., and a binder resin B with a softening point in the range of 115° to 135° C., and the binder resin A and the binder resin B are compatible with each other, so that the viscosity of the color toner is decreased when heated at the time of image fixing and the color toner is sufficiently fused for exhibiting satisfactory glossiness and transparency for use in practice.

Furthermore, because of the use of the above-mentioned binder resin composition, the intermolecular cohesion of the binder resin composition is not easily decreased, and accordingly the offset phenomenon is difficult to occur.

In the present invention, it is necessary that the binder resin A and the binder resin B be compatible with each other.

Furthermore, it is preferable that the binder resin A and binder resin B have the softening points in the respective ranges.

When the respective softening points are lower than the respective ranges, the offset phenomenon is apt to occur, and also the blocking of the toner is also apt to occur during the storage thereof.

On the other hand, when the respective softening points are higher than the respective ranges, the glossiness and transparency become insufficient for use in practice.

It is preferable that the mixing ratio of the binder resin A and the binder resin B be in the range of 20:80 to 80:20 in terms of parts-by-weight ratio.

In case a binder resin having a softening point which is between the softening point of the binder resin A and the softening point of the binder resin B is employed alone instead of the combination of the binder resin A and the binder resin B, sufficient anti-offset performance, glossiness and transparency for use in practice are difficult to obtain.

Furthermore, in the color of the present invention, a wax with a melting point in the range of 65° to 90° C., which is not compatible with the binder resin composition, is dispersed in the binder resin composition, so that during the image fixing step, the wax oozes from the surface of the toner particles and therefore the toner exhibits sufficient anti-offset performance for use in practice, without the application of an oil to the image fixing roller.

In the present invention, it is preferable that the wax be not compatible with the binder resin composition. When the wax is compatible with the binder resin composition, the wax does not effectively ooze from the surface of the toner particles, and therefore the offset phenomenon is apt to occur.

Furthermore, it is preferable that the wax have the melting point in the above-mentioned range.

When the melting point of the wax is lower than the above-mentioned range, it may occur the blocking of the toner takes place during the storage thereof; and the offset phenomenon also takes place.

On the other hand, when the melting point of the wax is higher than the above-mentioned range, it may occur that the offset phenomenon take places even when the temperature of the image fixing roller is still in a lower range than the normal image fixing temperature range.

The softening point of each binder resin for use in the present invention was measured as follows:

By use of Capillary Rheometer (Trademark "Flowtester CFT-500" made by Shimadzu Corporation), 1 $cm^3$ of a binder resin sample was fused and caused to flow under the conditions that capillary dies with a diameter of 1 mm were used, the applied pressure was set at 20 $kg/cm^2$, and the temperature elevation rate was set at 6° C./min; and the temperature corresponding to one half of the height from the flow initiation temperature to the flow termination temperature was determined as the softening point of the sample binder resin.

The melting point of the wax was measured by use of a commercially available tester (Trademark "Rigaku THERMOFLEX TG8110 TYPE" made by Rigaku Denki Co., Ltd.). More specifically, an endothermic curve of the wax was obtained with the temperature elevation rate of this tester set at 10° C./min, and the melting point was determined from a main maximum peak of the endothermic curve.

The compatible state of the binder resins, and the dispersion state of the wax in the binder resin composition can be confirmed by a transmission type electron microscope, and in the present invention, compatible state and incompatible state were distinguished by electron microscope photographs thereof with 100,000 magnifications taken by a transmission type electron microscope.

In the present invention, it is preferable that each of the binder resin A and the binder resin B have a main peak in the range of 3.5 to 4.5 in terms of the logarithmic molecular weight LogM thereof in the respective molecular weight distribution.

To be more specific, it is preferable that the molecular weights of the binder resins A and B be within the above-mentioned range. This is because when the difference between the molecular weight of the binder resin A and that of the binder resin B is excessively large, it may occur that uniform image fixing at a constant image fixing temperature becomes impossible, and accordingly, the fixed toner surface may lose its surface smoothness, so that appropriate glossiness and high transparency cannot be obtained, and the anti-offset performance will be impaired.

In contrast, when the molecular weights of the binder resins A and B are within the above-mentioned range, uniform image fixing can be performed at a constant image fixing temperature, and accordingly, high smoothness in the fixed toner surface, and appropriate glossiness and high transparency can be stably obtained without impairing the anti-offset performance.

The molecular weight of each of the binder resins for use in the present invention was measured by GPC Molecular Weight Measurement, which was conducted as follows:

In the measurement of the molecular weight, as an analysis column, Excelpak SEC-G14/G16/G18 made by Yokokawa Analytical Systems Co., Ltd. was employed.

The above-mentioned analysis column was stabilized at 40° C. in a temperature-constant chamber. THF serving as an eluent was flowed at a flow rate of 1 ml/min, and 200 $\mu$l of a THF solution of a test sample with a test sample concentration in the range of 0.05 to 0.5 wt. % was injected into the analysis column, whereby the molecular weight of the test sample was determined.

More specifically, the molecular weight was determined by a molecular weight distribution which was obtained from the retention time of the test sample in the column, based on a working curve prepared in advance.

The working curve employed above was prepared by use of several kinds of polystyrene samples, with each sample containing only one kind of polystyrene.

In the color toner of the present invention, it is preferable that each of the binder resin A and the binder resin B comprise a polyester resin or a polyol resin, in order to prepare a color toner with excellent glossiness, transparency and anti-offset performance.

As the polyester resin for use in the present invention, it is preferable to use a polyester resin prepared by condensation polymerization of:

(a) a diol component of formula (I):

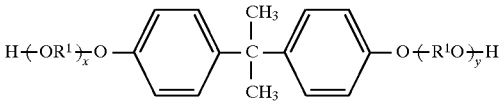

(I)

wherein $R^1$ is an alkylene group having 2 to 4 carbon atoms; and x and y represent a positive integer, with the total sum of x and y having an average value of 2 to 16; and (b) at least one acid component selected from the group consisting of:

(1) a dicarboxylic acid represented by formula (II)

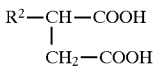

(II)

wherein $R^2$ is a saturated or unsaturated hydrocarbon group having 4 to 20 carbon atoms;

(2) an anhydride of the dicarboxylic acid of formula (II);

(3) a lower alkyl ester of the dicarboxylic acid of formula (II);

(4) a dicarboxylic acid represented by formula (III)

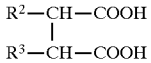

(III)

wherein $R^2$ and $R^3$ are a saturated or unsaturated hydrocarbon group having 4 to 20 carbon atoms;

(5) an anhydride of the dicarboxylic acid of formula (III);

(6) a lower alkyl ester of the dicarboxylic acid of formula (III);

(7) an aromatic polycarboxylic acid represented by formula (IV):

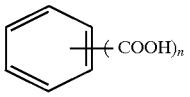

(IV)

wherein n is an integer of 2 to 3;

(8) a lower alkyl ester of the aromatic polycarboxylic acid of formula (IV); and (9) an anhydride of the aromatic polycarboxylic acid of formula (IV).

In the above and hereinafter, the lower alky ester may be, for example, a $C_1$–$C_4$ alkyl ester.

Specific examples of the diol component represented by formula (I) are polyoxypropylene(2,2)-2,2-bis(4-hydroxyphenyl)propane, polyoxyester(2)-2,2-bis(4-hydroxyphenyl)propane, polyoxypropylene(6)-2,2-bis(4-hydroxyphenyl)propane, polyoxypropylene(16)-2,2-bis(4-hydroxyphenyl)propane.

Furthermore, the following polyhydroxy compounds may be added in an amount of about 5 moles to 100 moles of the above-mentioned diol component: ethylene glycol, propylene glycol, glycerin, pentaerythritol, trimethylolpropane, hydrogenated bisphenol A, sorbitol, and etherified polyhydroxy compounds of the aforementioned compounds.

Specific examples of the dicarboxylic acid represented by formula (II) or formula (III) are succinic acid derivatives such as n-dodecenylsuccinic acid, n-dodecylsuccinic acid, n-butylsuccinic acid, iso-dodecenylsuccinic acid, and iso-octylsuccinic acid.

By use of these succinic acid derivatives, there can be obtained a color toner with excellent image fixing performance at low temperatures and improved glossiness.

An example of the aromatic polycarboxylic acid of formula (IV) for use in the present invention is trimellitic acid; and an example of the anhydride of the aromatic polycarboxylic acid represented by formula (V) is trimellitic acid anhydride.

Furthermore, as an additional acid component for the condensation polymerization, there can be employed at least one additional acid component selected from the group consisting of an aromatic polycarboxylic acid represented by formula (V):

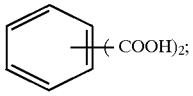

(V)

an anhydride of the aromatic polycarboxylic acid; and a lower alkyl ester of the aromatic polycarboxylic acid.

Specific examples of the aromatic polycarboxylic acid represented by formula (V) include phthalic acid, isophthalic acid and terephthalic acid. Accordingly, anhydrides and lower alkyl esters thereof can also be employed as the above-mentioned additional acid components.

In addition, as such an additional acid component, maleic acid, fumaric acid, anhydrides and lower alkyl esters thereof can also be employed.

The above-mentioned polyester resin can be prepared by subjecting the diol component of formula (I) and at least one acid component as mentioned above to condensation polymerization in an inert atmosphere at 180° to 250° C.

As the polyol resin for use in the present invention, various kinds of polyol resins can be employed.

In the present invention, it is preferable to employ a polyol resin which is prepared by allowing the following components to react: (1) an epoxy resin; (2) an alkylene oxide adduct of a dihydric phenol or a glycidyl ether of the alkylene oxide adduct; (3) a compound having in the molecule thereof one active hydrogen atom which is capable of reacting with epoxy group; and (4) a compound having in the molecule thereof two or more active hydrogen atoms which are capable of reacting with epoxy group.

As the above-mentioned epoxy resin (1), it is preferable to employ at least two kinds of bisphenol A type epoxy resins with different number average molecular weights. A polyol resin prepared by using such epoxy resins imparts excellent glossiness, transparency and anti-offset performance to the color toner of the present invention.

As the epoxy resin for use in the present invention, it is preferable to employ an epoxy resin prepared by allowing a bisphenol such as bisphenol A or bisphenol F to react with epichlorohydrin.

In order to impart stable image fixing characteristics and glossiness to the color toner, it is preferable that the epoxy resin for use in the present invention be composed of at least two kinds of bisphenol A type epoxy resin components with different number average molecular weights, namely a low-molecular-weight bisphenol A type epoxy resin component with a number average molecular weight of 360 to 2000 and a high-molecular-weight bisphenol A type epoxy resin component with a number average molecular weight of 3000 to 10000. Furthermore, it is preferable that the amount of the low-molecular-weight bisphenol A type epoxy resin component be in the range of 20 to 50 wt. %, and the amount of the high-molecular-weight bisphenol A type epoxy resin component be in the range of 4 to 50 wt. %.

In case the amount of the low-molecular-weight bisphenol A type epoxy resin component is excessive or the low-molecular-weight bisphenol A type epoxy resin component has a number average molecular weight of less than 360, the glossiness of the color toner tends to be excessive or the preservability of the color toner tends to be impaired. On the other hand, in case the amount of the high-molecular-weight bisphenol A type epoxy resin component is excessive or the high-molecular-weight bisphenol A type epoxy resin component has a number average molecular weight of more than 10000, the glossiness of the color toner tends to be insufficient or the preservability of the color toner tends to be impaired.

Specific examples of the alkylene oxide adduct of a dihydric phenol for use in the present invention are reaction products of (a) ethylene oxide, propylene oxide, butylene oxide or mixtures thereof, and (b) a bisphenol such as bisphenol A and bisphenol F.

The thus obtained alkylene oxide adduct may be used by allowing the alkylene oxide adduct to react with epichlorohydrin or β-methyl epichlorohydrin. In particular, a glycidyl ether of the alkylene oxide adduct of bisphenol A of the following formula (VI) is preferable for use in the present invention:

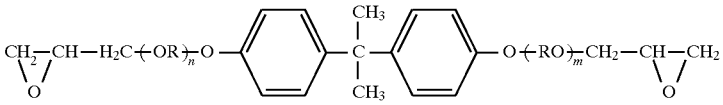

(VI)

wherein R represents $—CH_2—CH_2—$, $—CH_2—CH(CH_3)—$, or $—CH_2—CH_2—CH_2—$; and n and m are respectively an integer of 1 or more, provided that n+m=2 to 6.

It is preferable that the alkylene oxide adduct of a dihydric phenol or a glycidyl ether of the alkylene oxide adduct be in an amount of 10 to 40 parts by weight to 100 parts by weight of the polyol resin. When the amount of the alkylene oxide adduct or a glycidyl ether thereof is less than the above-mentioned amount, problems such as curling occurs in a toner-image-bearing material. Furthermore, when n+m is 7 or more, or when the amount of the alkylene oxide adduct or a glycidyl ether thereof is more than the above-mentioned amount, the glossiness of the color toner becomes excessive or the preservability of the color toner tends to be impaired.

Examples of the compound having in the molecule thereof one active hydrogen atom which is capable of reacting with epoxy group for use in the present invention are monohydric phenols, secondary amines and carboxylic acids.

Specific examples of monohydric phenols are phenol, cresol, isopropylphenol, amino phenol, nonylphenol, dodecylphenol, xylenol, and p-cumylphenol.

Specific examples of secondary amines are diethylamine, dipropylamine, dibutylamine, N-methyl(ethyl)piperazine, and piperidine.

Specific examples of carbolic acids are propionic acid and caproic acid.

In order to obtain a polyol resin having an epoxy resin moiety and an alkylene oxide moiety in the main chain thereof for use in the present invention, there are various combinations of starting materials therefor.

Such a polyol resin can be obtained by allowing an epoxy resin having two glycidyl terminal groups and an alkylene oxide adduct of a dihydric phenol having two glycidyl terminal groups to react with dihalide, diisocyanate, diamine, dithiol, polyhdyric phenol, or dicarboxylic acid.

In the above, it is most preferable that the above epoxy resin and alkylene oxide adduct be allowed to react with a dihydric phenol.

It is also preferable that a polyhydric phenol or a polycarboxylic acid be used in combination with a dihydric phenol as long as no gelation takes place.

When a polyhydric phenol or a polycarboxylic acid is employed in combination with a dihydric phenol, the amount thereof is 15 wt. % or less, preferably 10 wt. % or less, of the entire weight of the mixture.

Examples of the compound having in the molecule thereof two or more active hydrogen atoms which are capable of reacting with epoxy group, for use in the present invention, are dihydric phenols, polyhydric phenols, and polycarboxylic acids.

Specific examples of dihydric phenols are bisphenols such as bisphenol A, and bisphenol F. Specific examples of polyhydric phenols are orthochromatic cresol novolac, phenol novolac, tris(4-hydroxyphenyl)methane, and 1-[α-methyl-α-(4-hydroxyphenyl)ethyl]benzene. Specific examples of polyhydric carboxylic acids are malonic acid, succinic acid, glutaric acid, adipic acid, maleic acid, phthalic acid, terephthalic acid, trimellitic acid, and trimellitic acid anhydride.

It is preferable that these polyester resins and polyol resins be not crosslinked or slightly crosslinked with such a degree that the amount of an insoluble component thereof is 5% or less when dissolved in THF, since when the crosslinking density thereof is high, it is difficult to obtain appropriate transparency and glossiness in the color toner.

In the color toner of the present invention, it is preferable that the Mw/Mn ratio of the wax which is not compatible with the binder resin composition be in the range of 1.0 to 1.2. Although the reason therefor has not yet been clarified, it is considered that when the Mw/Mn ratio is in the range of 1.0 to 1.2, the oozing of the wax from the surface of the toner particles can be effectively performed at the time of image fixing, so that a sufficient anti-offset performance for use in practice can be imparted to the color toner.

Furthermore, when an ester wax or an olefin wax is employed as the above-mentioned wax, the anti-offset performance of the color toner is significantly improved. These waxes are incompatible with the binder resin composition, but can be uniformly dispersed in the binder resin composition, so that excellent anti-offset performance can be obtained at the time of image fixing. In particular, when any of these waxes is used in combination with the previously mentioned polyester resin or polyol resin serving as the binder resin, the above-mentioned effect of obtaining high anti-offset performance is particularly enhanced.

In the present invention, the ester wax means an ester-bond-containing wax. Specific examples of the ester wax are natural waxes such as candelilla wax, carnauba wax and rice wax; and montan wax.

Specific examples of the olefin wax are polyethylene wax and polypropylene wax.

Other materials that can be employed in the color toner of the present invention will now be explained.

As binder resins that can be added to the binder resins A and B for use in the present invention, the following binder resins can be employed: homopolymers of styrene or substituted styrenes such as polystyrene, poly-p-chlorostyrene copolymer, and polyvinyltoluene; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloro-methacrylate copolymer, styrene acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-butadiene copolymer, styrene-isoprene copolymer, styrene-acrylonitrile-indene copolymer, styrene-maleic acid copolymer, and styrene-maleic acid ester copolymer; polymethyl methacrylate; polybutyl methacrylate; polyvinyl chloride; polyvinyl acetate; polyethylene; polypropylene; polyester; polyurethane; polyamide; epoxy resin; polyvinyl butyral; polyacrylic resin; rosin; modified rosin; terpene resin; and phenolic resin.

As the coloring agent for use in the color toner of the present invention, dyes and pigments capable of providing color toners for yellow, magenta, cyan and black colors can be employed.

Specific examples of such a coloring agent are Carbon Black, Lamp Black, Ultramarine, Aniline Blue, Phthalocyanine Blue, Phthalocyanine Green, Hansa Yellow G, Rhodamine 6G, Lake, Chalco Oil Blue, Chrome Yellow, Quinacridone, Benzidine Yellow, Rose Bengale, and Triarylmethane.

Other conventional dyes and pigments can be employed alone or in combination in the present invention. It is preferable that such a coloring agent be employed in an amount of 1 to 30 parts by weight, more preferably in an amount of 3 to 20 parts by weight, to 100 parts by weight of the binder resin composition.

It is preferable to contain a charge controlling agent in the color toner of the present invention, in order to impart stable negative or positive chargeability to the color toner, thereby securing a stable charge quantity in the color toner.

As such a charge controlling agent for use in the present invention, it is preferable to use a transparent or white charge controlling agent, in order that the color of the color toner is not impaired by the addition of the charge controlling agent thereto.

Specific examples of a positive charge controlling agent are quaternary ammonium salts, imidazole metal complexes, and other salts; and specific examples of a negative charge controlling agent are salicylic acid metal complexes, salts; and organic boron salts.

It is preferable that the particle size of the color toner of the present invention be in the range of about 3 to 10 $\mu$m, since when the particle size is smaller than the above range, there may be a case where toner particles are deposited on the background of an image-bearing transfer sheet at the time of development; the fluidity of the toner is decreased; the replenishment of the toner becomes difficult; or the cleaning performance of the toner is degraded. On the other hand, when the particles size of the toner is larger than the above-mentioned range, the resolution of developed images is degraded.

As an additive for the toner of the present invention, for instance, finely-divided particles of hydrophobic silica, titanium oxide, or alumina may be employed for improving the fluidity of the color toner of the present invention.

When necessary, metallic salts of fatty acids such as zinc stearate and aluminum stearate; and polyvinylidene fluoride may be added to the color toner of the present invention.

Other features of this invention will become apparent in the course of the following description of exemplary embodiments, which are given for illustration of the invention and are not intended to be limiting thereof.

EXAMPLE 1

[Preparation of Yellow Toner]

The following components were thoroughly mixed in a blender, kneaded under the application of heat thereto in a two-roll mill at 100° to 110° C., and then cooled to room temperature, whereby a kneaded lump was obtained:

| | Parts by Weight |
|---|---|
| Binder resin A (stryene/n-butyl methacrylate copolymer with a softening point of 100° C. and a peak molecular weight of 3.3 in terms of LogM) | 40 |
| Binder resin B (stryene/n-butyl methacrylate copolymer with a softening point of 123° C. and a peak molecular weight of 3.9 in terms of LogM) | 60 |
| Wax (micro wax with a melting point of 89° C. Mw = 450, Mn = 300, and Mw/Mn = 1.50) | 5 |
| Disazo Yellow Pigment (C.I. Pigment Yellow 17) | 5 |
| Charge controlling agent (Zinc salt of salicylic acid derivative) | 2 |

The thus obtained lump was roughly ground in a cutter mill, and finely pulverized in a pulverizer using air jet. Then, the pulverized mixture was classified by an air classification apparatus, whereby yellow-colored matrix particles with a volume mean diameter of 7.4 $\mu$m were obtained. The volume mean diameter of the matrix particles was measured by the Coulter counter method using a commercially available measuring instrument (Trademark "Coulter Counter Model TA-II" made by Coulter Electronics, Ltd.).

Then, 100 parts by weight of the yellow-colored matrix particles and 0.5 parts by weight of hydrophobic silica were mixed in a Henschel mixer, whereby a yellow toner according to the present invention was prepared.

[Preparation of Magenta Toner]

The above-mentioned procedure for preparation of the yellow toner was repeated except that the coloring agent in the formulation of the yellow-colored matrix particles for the yellow toner was replaced by a quinacridone magenta pigment (C.I. Pigment Red 122) in an amount of 4 parts by weight, whereby a magenta toner according to the present invention was prepared.

The volume mean diameter of the magenta-colored matrix particles was 7.5 $\mu$m.

[Preparation of Cyan Toner]

The above-mentioned procedure for preparation of the yellow toner was repeated except that the coloring agent in the formulation of the yellow-colored matrix particles for the yellow toner was replaced by a copper phthalocyanine blue pigment (C.I. Pigment Blue 15) in an amount of 2 parts by weight, whereby a cyan toner according to the present invention was prepared.

The volume mean diameter of the cyan-colored matrix particles was 7.6 $\mu$m.

[Preparation of Black Toner]

The above-mentioned procedure for preparation of the yellow toner was repeated except that the coloring agent in the formulation of the yellow-colored matrix particles for the yellow toner was replaced by carbon black in an amount of 6 parts by weight, whereby a black toner according to the present invention was prepared.

The volume mean diameter of the black-colored matrix particles was 7.3 μm.

Table 1 shows the composition of each of the above prepared color toners.

[Preparation of Developers]

5 parts by weight of each color toner were separately mixed with 100 parts by weight of ferrite carrier particles prepared by coating a silicone resin on the surface of ferrite core particles with an average particle size of 50 μm in a tumbler mixer, whereby yellow, magenta, cyan and black developers were obtained.

The thus obtained color developers were set in a commercially available color copying machine (Trademark "PRETER 550", made by Ricoh Company, Ltd.). With no oil being applied to the surface of an image-fixing roller of the above-mentioned color copying machine, image formation was conducted to evaluate the above toners with respect to the following items:

(1) Offset-free image fixing temperature range:

Using a commercially available color copying machine (Trademark "PRETER 550", made by Ricoh Company, Ltd.), solid images of a monochromatic color such as yellow, magenta, cyan and black, and a medium color such as red, blue and green were developed on a commercially available transfer sheet (Trademark "Type 6000-70W", made by Ricoh Company, Ltd.), with the deposition amount of each toner of a monochromatic color being controlled to 1.0±0.1 mg/cm$^2$. In this case, no oil was applied to the surface of the image-fixing roller, and the image-fixing temperature where no offset phenomenon occurred was measured, with the adjustment of the temperature of the image-fixing roller so as to be variable.

(2) Glossiness

A solid image sample made of a monochromatic color toner was fixed on a sheet, with the temperature of the image-fixing roller of the color copying machine being set at 160° C. The glossiness of the thus obtained solid image sample was measured by a commercially available glossmeter (made by Nippon Denshoku Kogyo Co., Ltd.), with the angle of light incidence being set at 60°.

The higher the value of glossiness, the higher the gloss of a solid color image. It is preferable that a full-color copy image have a glossiness of about 10 to 30%.

(3) Haze

A solid image sample made of a monochromatic color toner was fixed on a commercially available OHP film (Trademark "Type PPC-DX", made by Ricoh Company, Ltd.), with the temperature of the image-fixing roller of the color copying machine being set at 160° C. The haze of the thus obtained solid image sample was measured by a commercially available haze measuring instrument (Trademark "Digital Haze Computer HGM-2DP", made by Suga Test Instruments Co., Ltd.).

The degree of haze is a criterion for evaluating the transparency of a color toner. The lower the haze value, the higher the transparency of a color toner image. Furthermore, that the transparency of a color toner image is high signifies that the color development performance is good when the color toner image is fixed on an OHP film.

It is preferable that the haze value be 30% or less for realizing excellent color development performance.

The results of the above-mentioned evaluation tests (1) to (3) are shown in Table 2.

As is apparent from the results shown in Table 2, clear full-color images were obtained with excellent image-fixing performance and proper glossiness. In addition, the offset-free image-fixing temperature range was very broad, and the color development performance of color toner images obtained on an OHP film was excellent.

EXAMPLE 2

[Preparation of Yellow Toner]

The following components were thoroughly mixed in a blender, kneaded under the application of heat thereto in a two-roll mill at 100° to 110° C., and then cooled to room temperature, whereby a kneaded lump was obtained:

| | Parts by Weight |
|---|---|
| Binder resin A (stryene/n-butyl methacrylate copolymer with a softening point of 100° C. and a peak molecular weight of 4.4 in terms of LogM) | 30 |
| Binder resin B (stryene/n-butyl methacrylate copolymer with a softening point of 123° C. and a peak molecular weight of 3.9 in terms of LogM) | 70 |
| Wax (paraffin wax with a melting point of 70° C. Mw = 300, Mn = 240, and Mw/Mn = 1.25) | 6 |
| Disazo Yellow Pigment (C.I. Pigment Yellow 17) | 5 |
| Charge controlling agent (Zinc salt of salicylic acid derivative) | 2 |

The thus obtained lump was roughly ground in a cutter mill, and finely pulverized in a pulverizer using air jet. Then, the pulverized mixture was classified by an air classification apparatus, whereby yellow-colored matrix particles with a volume mean diameter of 7.3 μm were obtained. The volume mean diameter of the matrix colored particles was measured in the same manner as in Example 1.

Then, 100 parts by weight of the yellow-colored matrix particles and 0.5 parts by weight of hydrophobic silica were mixed in a Henschel mixer, whereby a yellow toner according to the present invention was prepared.

[Preparation of Magenta Toner]

The above-mentioned procedure for preparation of the yellow toner was repeated except that the coloring agent in the formulation of the yellow-colored matrix particles for the yellow toner was replaced by a quinacridone magenta pigment (C.I. Pigment Red 122) in an amount of 4 parts by weight, whereby a magenta toner according to the present invention was prepared.

The volume mean diameter of the magenta-colored matrix particles was 7.5 μm.

[Preparation of Cyan Toner]

The above-mentioned procedure for preparation of the yellow toner was repeated except that the coloring agent in the formulation of the yellow-colored matrix particles for the yellow toner was replaced by a copper phthalocyanine blue pigment (C.I. Pigment Blue 15) in an amount of 2 parts by weight, whereby a cyan toner according to the present invention was prepared.

The volume mean diameter of the cyan-colored matrix particles was 7.4 μm.

[Preparation of Black Toner]

The above-mentioned procedure for preparation of the yellow toner was repeated except that the coloring agent in the formulation of the yellow-colored matrix particles for the yellow toner was replaced by carbon black in an amount of 6 parts by weight, whereby a black toner according to the present invention was prepared.

The volume mean diameter of the black-colored matrix particles was 7.5 μm.

Table 1 shows the composition of each of the above prepared color toners.

[Preparation of Developers]

5 parts by weight of each color toner were separately mixed with 100 parts by weight of ferrite carrier particles prepared by coating a silicone resin on the surface of ferrite core particles with an average particle size of 50 μm in a tumbling mixer, whereby yellow, magenta, cyan and black developers were obtained.

The same evaluation tests as employed in Example 1 were conducted by setting the above obtained color developers in the commercially available color copying machine (Trademark "PRETER 550", made by Ricoh Company, Ltd.).

The results of the evaluation tests are shown in Table 2.

As is apparent from the results shown in Table 2, clear full-color images were obtained with excellent image-fixing performance and proper glossiness. In addition, the offset-free image-fixing temperature range was very broad, and the color development performance on an OHP film was excellent.

EXAMPLE 3

[Preparation of Yellow Toner]

The following components were thoroughly mixed in a blender, kneaded under the application of heat thereto in a two-roll mill at 100° to 110° C., and then cooled to room temperature, whereby a kneaded lump was obtained:

| | Parts by Weight |
|---|---|
| Binder resin A (polyol resin with a softening point of 105° C. and a peak molecular weight of 4.0 in terms of LogM, obtained by polymerization of low-molecular weight bisphenol type epoxy resin with an Mn value of about 360, high-molecular weight bisphenol type epoxy resin with an Mn value of about 2700, glycidyl compound of bisphenol A type propylene oxide adduct, bisphenol F2, and p-cumylphenol) | 70 |
| Binder resin B (polyester resin with a softening point of 120° C. and a peak molecular weight of 4.1 in terms of LogM, obtained by polymerization of ethylene oxide adduct of bisphenol A, propylene oxide adduct, terephthalic acid, succinic acid derivative, and trimellitic acid anhydride) | 30 |
| Wax (ester wax: carnauba wax free of free aliphatic acids with a melting point of 83° C. Mw = 4600, Mn = 2700, and Mw/Mn = 1.70) | 5 |
| Disazo Yellow Pigment (C.I. Pigment Yellow 17) | 5 |
| Charge controlling agent (Zinc salt of salicylic acid derivative | 2 |

The thus obtained lump was roughly ground in a cutter mill, and finely pulverized in a pulverizer using air jet. Then, the pulverized mixture was classified by an air classification apparatus, whereby yellow-colored matrix particles with a volume mean diameter of 7.6 μm were obtained. The volume mean diameter of the matrix particles was measured in the same manner as in Example 1.

Then, 100 parts by weight of the yellow-colored matrix particles and 0.5 parts by weight of hydrophobic silica were mixed in a Henschel mixer, whereby a yellow toner according to the present invention was prepared.

[Preparation of Magenta Toner]

The above-mentioned procedure for preparation of the yellow toner was repeated except that the coloring agent in the formulation of the yellow-colored matrix particles for the yellow toner was replaced by a quinacridone magenta pigment (C.I. Pigment Red 122) in an amount of 4 parts by weight, whereby a magenta toner according to the present invention was prepared.

The volume mean diameter of the magenta-colored matrix particles was 7.3 μm.

[Preparation of Cyan Toner]

The above-mentioned procedure for preparation of the yellow toner was repeated except that the coloring agent in the formulation of the yellow-colored matrix particles for the yellow toner was replaced by a copper phthalocyanine blue pigment (C.I. Pigment Blue 15) in an amount of 2 parts by weight, whereby a cyan toner according to the present invention was prepared.

The volume mean diameter of the cyan-colored matrix particles was 7.7 μm.

[Preparation of Black Toner]

The above-mentioned procedure for preparation of the yellow toner was repeated except that the coloring agent in the formulation of the yellow-colored matrix particles for the yellow toner was replaced by carbon black in an amount of 6 parts by weight, whereby a black toner according to the present invention was prepared.

The volume means diameter of the black-colored matrix particles was 7.2 μm.

Table 1 shows the composition of each of the above prepared color toners.

[Preparation of Developers]

5 parts by weight of each color toner were separately mixed with 100 parts by weight of ferrite carrier particles prepared by coating a silicone resin on ferrite core particles with an average particle size of 50 μm in a tumbler mixer, whereby yellow, magenta, cyan and black developers were obtained.

The same evaluation tests as employed in Example 1 were conducted by setting the above obtained color developers in the commercially available color copying machine (Trademark "PRETER 550", made by Ricoh Company, Ltd.).

The results of the evaluation tests are shown in Table 2.

As is apparent from the results shown in Table 2, clear full-color images were obtained with excellent image-fixing performance and proper glossiness. In addition, the offset-free image-fixing temperature range was very broad, and the color development performance on an OHP film was excellent.

EXAMPLE 4

[Preparation of Yellow Toner]

The following components were thoroughly mixed in a blender, kneaded under the application of heat thereto in a two-roll mill at 100° to 110° C., and then cooled to room temperature, whereby a kneaded lump was obtained:

| | Parts by Weight |
|---|---|
| Binder resin A (styrene/n-butyl methacrylate copolymer with a softening point of 100° C. and a peak molecular weight of 4.4 in terms of LogM) | 30 |
| Binder resin B (polyol resin with a softening point of 115° C. and a peak molecular weight of 3.8 in terms of LogM, obtained by polymerization of low-molecular weight bisphenol A type epoxy resin with an Mn value of 680, high-molecular weight bisphenol A type epoxy resin with an Mn value of 6500, glycidyl compound of bisphenol A type ethylene oxide adduct, bisphenol F, and p-cumylphenol) | 70 |
| Wax (paraffin wax with a melting point of 70° C. Mw = 300, Mn = 240, and Mw/Mn = 1.25) | 5 |
| Disazo Yellow Pigment (C.I. Pigment Yellow 17) | 5 |
| Charge controlling agent (Zinc salt of salicylic acid derivative | 2 |

The thus obtained lump was roughly ground in a cutter mill, and finely pulverized in a pulverizer using air jet. Then, the pulverized mixture was classified by an air classification apparatus, whereby yellow-colored matrix particles with a volume means diameter of 7.5 μm were obtained. The volume mean diameter of the matrix particles was measured in the same manner as in Example 1.

Then, 100 parts by weight of the yellow-colored matrix particles and 0.5 parts by weight of hydrophobic silica were mixed in a Henschel mixer, whereby a yellow toner according to the present invention was prepared.

[Preparation of Magenta Toner]

The above-mentioned procedure for preparation of the yellow toner was repeated except that the coloring agent in the formulation of the yellow-colored matrix particles for the yellow toner was replaced by a quinacridone magenta pigment (C.I. Pigment Red 122) in an amount of 4 parts by weight, whereby a magenta toner according to the present invention was prepared.

The volume mean diameter of the magenta-colored matrix particles was 7.6 μm.

[Preparation of Cyan Toner]

The above-mentioned procedure for preparation of the yellow toner was repeated except that the coloring agent in the formulation of the yellow-colored matrix particles for the yellow toner was replaced by a copper phthalocyanine blue pigment (C.I. Pigment Blue 15) in an amount of 2 parts by weight, whereby a cyan toner according to the present invention was prepared.

The volume mean diameter of the cyan-colored matrix particles was 7.8 μm.

[Preparation of Black Toner]

The above-mentioned procedure for preparation of the yellow toner was repeated except that the coloring agent in the formulation of the yellow-colored matrix particles for the yellow toner was replaced by carbon black in an amount of 6 parts by weight, whereby a black toner according to the present invention was prepared.

The volume mean diameter of the black-colored matrix particles was 7.3 μm.

Table 1 shows the composition of each color toner.

[Preparation of Developers]

5 parts by weight of each color toner were separately mixed with 100 parts by weight of ferrite carrier particles prepared by coating a silicone resin on ferrite core particles with an average particle size of 50 μm in a tumbler mixer, whereby yellow, magenta, cyan and black developers were obtained.

The same evaluation tests as employed in Example 1 were conducted by setting the above obtained color developers in the commercially available color copying machine (Trademark "PRETER 550", made by Ricoh Company, Ltd.).

The results of the evaluation tests are shown in Table 2.

As is apparent from the results shown in Table 2, clear full-color images were obtained with excellent image-fixing performance and proper glossiness. In addition, the offset-free image-fixing temperature range was very broad, and the color development performance on an OHP film was excellent.

EXAMPLE 5

[Preparation of Yellow Toner]

The following components were thoroughly mixed in a blender, kneaded under the application of heat thereto in a two-roll mill at 100° to 110° C., and then cooled to room temperature, whereby a kneaded lump was obtained:

| | Parts by Weight |
|---|---|
| Binder resin A (polyester resin with a softening | 70 |

-continued

| | Parts by Weight |
|---|---|
| point of 105° C. and a peak molecular weight of 3.7 in terms of LogM, obtained by polymerization of propylene oxide adduct of bisphenol A, terephthalic acid, and fumaric acid) | |
| Binder resin B (polyol resin with a softening point of 115° C. and a peak molecular weight of 3.8 in terms of LogM, obtained by polymerization of low-molecular weight bisphenol of A type epoxy resin with an Mn value of 680, high-molecular weight bisphenol A type epoxy resin with an Mn value of 6500, glycidyl compound of bisphenol A type ethylene oxide adduct, bisphenol F, and p-cumylphenol) | 30 |
| Wax (ester wax with a melting point of 80° C. Mw = 4400, Mn = 3800, and Mw/Mn = 1.16) | 5 |
| Disazo Yellow Pigment (C.I. Pigment Yellow 17) | 5 |
| Charge controlling agent (Zinc salt of salicylic acid derivative) | 2 |

The thus obtained lump was roughly ground in a cutter mill, and finely pulverized in a pulverizer using air jet. Then, the pulverized mixture was classified by an air classification apparatus, whereby yellow-colored matrix particles with a volume mean diameter of 7.5 μm were obtained. The volume mean diameter of the matrix particles was measured in the same manner as in Example 1.

Then, 100 parts by weight of the yellow-colored matrix particles and 0.5 parts by weight of hydrophobic silica were mixed in a Henschel mixer, whereby a yellow toner according to the present invention was prepared.

[Preparation of Magenta Toner]

The above-mentioned procedure for preparation of the yellow toner was repeated except that the coloring agent in the formulation of the yellow-colored matrix particles for the yellow toner was replaced by a quinacridone magenta pigment (C.I. Pigment Red 122) in an amount of 4 parts of weight, whereby a magenta toner according to the present invention was prepared.

The volume mean diameter of the magenta-colored matrix particles was 7.4 μm.

[Preparation of Cyan Toner]

The above-mentioned procedure for preparation of the yellow toner was repeated except that the coloring agent in the formulation of the yellow-colored matrix particles for the yellow toner was replaced by a copper phthalocyanine blue pigment (C.I. Pigment Blue 15) in an amount of 2 parts by weight, whereby a cyan toner according to the present invention was prepared.

The volume mean diameter of the cyan-colored matrix particles was 7.3 μm.

[Preparation of Black Toner]

The above-mentioned procedure for preparation of the yellow toner was repeated except that the coloring agent in the formulation of the yellow-colored matrix particles for the yellow toner was replaced by carbon black in an amount of 6 parts by weight, whereby a black toner according to the present invention was prepared.

The volume mean diameter of the black-colored matrix particles was 7.7 μm.

Table 1 shows the composition of each of the above prepared color toners.

[Preparation of Developers]

5 parts by weight of each color toner were mixed with 100 parts by weight of ferrite carrier particles prepared by coating a silicone resin on the surface of ferrite core particles with an average particle size of 50 μm in a tumbler mixer, whereby yellow, magenta, cyan and black developers were obtained.

The same evaluation tests as employed in Example 1 were conducted by setting the above obtained color developers in the commercially available color copying machine (Trademark "PRETER 550", made by Ricoh Company, Ltd.).

The results of the evaluation tests are shown in Table 2.

As is apparent from the results shown in Table 2, clear full-color images were obtained with excellent image-fixing performance and proper glossiness. In addition, the offset-free image-fixing temperature range was very broad, and the color development performance on an OHP film was excellent.

EXAMPLE 6

[Preparation of Yellow Toner]

The following components were thoroughly mixed in a blender, kneaded under the application of heat thereto in a two-roll mill at 100° to 110° C., and then cooled to room temperature, whereby a kneaded lump was obtained:

| | Parts by Weight |
|---|---|
| Binder resin A (polyester resin with a softening point of 105° C. and a peak molecular weight of 3.7 in terms of LogM, obtained by polymerization of propylene oxide adduct of bisphenol A, terephthalic acid, and fumaric acid) | 60 |
| Binder resin B (polyol resin with a softening point of 120° C. and a peak molecular weight of 4.1 in terms of LogM, obtained by polymerization of ethylene oxide adduct of bisphenol A, propylene oxide adduct, terephthalic acid, succinic acid derivative, and trimellitic acid anyhdride) | 40 |
| Wax (polyethylene wax with a melting point of 80° C. Mw = 542, Mn = 517, and Mw/Mn = 1.05) | 6 |
| Disazo Yellow Pigment (C.I. Pigment Yellow 17) | 5 |
| Charge controlling agent (Zinc salt of salicylic acid derivative) | 2 |

The thus obtained lump was roughly ground in a cutter mill, and finely pulverized in a pulverizer using air jet. Then, the pulverized mixture was classified by an air classification apparatus, whereby yellow-colored matrix particles with a volume mean diameter of 7.6 μm were obtained. The volume mean diameter of the matrix particles was measured in the same manner as in Example 1.

Then, 100 parts by weight of the yellow-colored matrix particles and 0.5 parts by weight of hydrophobic silica were mixed in a Henschel mixer, whereby a yellow toner according to the present invention was prepared.

[Preparation of Magenta Toner]

The above-mentioned procedure for preparation of the yellow toner was repeated except that the coloring agent in the formulation of the yellow-colored matrix particles for the yellow toner was replaced by a quinacridone magenta pigment (C.I. Pigment Red 122) in an amount of 4 parts by weight, whereby a magenta toner according to the present invention was prepared.

The volume mean diameter of the magenta-colored matrix particles was 7.4 μm.

[Preparation of Cyan Toner]

The above-mentioned procedure for preparation of the yellow toner was repeated except that the coloring agent in the formulation of the yellow-colored matrix particles for the yellow toner was replaced by a copper phthalocyanine blue pigment (C.I. Pigment Blue 15) in an amount of 2 parts by weight, whereby a cyan toner according to the present invention was prepared.

The volume mean diameter of the cyan-colored matrix particles was 7.5 μm.

[Preparation of Black Toner]

The above-mentioned procedure for preparation of the yellow toner was repeated except that the coloring agent in the formulation of the yellow-colored matrix particles for the yellow toner was replaced by carbon black in an amount of 6 parts by weight, whereby a black toner according to the present invention was prepared.

The volume mean diameter of the black-colored matrix particles was 7.2 μm.

Table 1 shows the composition of each of the above prepared color toners.

[Preparation of Developers]

5 parts by weight of each color toner were separately mixed with 100 parts by weight of ferrite carrier particles prepared by coating a silicone resin on the surface of ferrite core particles with an average particle size of 50 μm in a tumbler mixer, whereby yellow, magenta, cyan and black developers were obtained.

The same evaluation tests as employed in Example 1 were conducted by setting the above obtained color developers in the commercially available color copying machine (Trademark "PRETER 550", made by Ricoh Company, Ltd.).

The results of the evaluation tests are shown in Table 2.

As is apparent from the results shown in Table 2, clear full-color images were obtained with excellent image-fixing performance and proper glossiness. In addition, the offset-free image-fixing temperature range was very broad, and the color development performance on an OHP film was excellent.

COMPARATIVE EXAMPLE 1

[Preparation of Yellow Toner]

The following components were thoroughly mixed in a blender, kneaded under the application of heat thereto in a two-roll mill at 100° to 110° C., and then cooled to room temperature, whereby a kneaded lump was obtained:

| | Parts by Weight |
|---|---|
| Binder resin A (styrene/n-butyl methacrylate copolymer with a softening point of 100° C. and a peak molecular weight of 4.4 in terms of LogM) | 30 |
| Binder resin B (polyester resin with a softening point of 139° C. and a peak molecular weight of 4.1 in terms of LogM, obtained by polymerization of ethylene oxide adduct of bisphenol A, propylene oxide adduct, terephthalic acid, succinic acid derivative, and trimellitic acid anyhdride) | 70 |
| Wax (paraffin wax with a melting point of 62° C. Mw = 240, Mn = 190, and Mw/Mn = 1.26) | 5 |
| Disazo Yellow Pigment (C.I. Pigment Yellow 17) | 5 |
| Charge controlling agent (Zinc salt of salicylic acid derivative) | 2 |

The thus obtained lump was roughly ground in a cutter mill, and finely pulverized in a pulverizer using air jet. Then, the pulverized mixture was classified by an air classification apparatus, whereby yellow-colored matrix particles with a volume mean diameter of 7.5 μm were obtained. The volume mean diameter of the matrix particles was measured in the same manner as in Example 1.

Then, 100 parts by weight of the yellow-colored matrix particles and 0.5 parts by weight of hydrophobic silica were mixed in a Henschel mixer, whereby a comparative yellow toner was prepared.

[Preparation of Magenta Toner]

The above-mentioned procedure for preparation of the comparative yellow toner was repeated except that the coloring agent in the formulation of the yellow-colored matrix particles for the comparative yellow toner was replaced by a quinacridone magenta pigment (C.I. Pigment Red 122) in an amount of 4 parts by weight, whereby a comparative magenta toner was prepared.

The volume mean diameter of the magenta-colored matrix particles was 7.6 μm.

[Preparation of Cyan Toner]

The above-mentioned procedure for preparation of the comparative yellow toner was repeated except that the coloring agent in the formulation of the yellow-colored matrix particles for the comparative yellow toner was replaced by a copper phthalocyanine blue pigment (C.I. Pigment Blue 15) in an amount of 2 parts by weight, whereby a comparative cyan toner was prepared.

The volume mean diameter of the cyan-colored matrix particles was 7.4 μm.

[Preparation of Black Toner]

The above-mentioned procedure for preparation of the comparative yellow toner was repeated except that the coloring agent in the formulation of the yellow-colored matrix particles for the comparative yellow toner was replaced by carbon black in an amount of 6 parts by weight, whereby a comparative black toner was prepared.

The volume mean diameter of the black-colored matrix particles was 7.3 μm.

Table 1 shows the composition of each of the above prepared comparative color toners.

[Preparation of Developers]

5 parts by weight of each comparative color toner were separately mixed with 100 parts by weight of ferrite carrier particles prepared by coating a silicone resin on the surface of ferrite core particles with an average particle size of 50 μm in a tumbler mixer, whereby comparative yellow, magenta, cyan and black developers were obtained.

The same evaluation tests as employed in Example 1 were conducted by setting the above obtained comparative color developers in the commercially available color copying machine (Trademark "PRETER 550", made by Ricoh Company, Ltd.).

The results of the evaluation tests are shown in Table 2.

Although the offset-free image-fixing temperature range was rather broad, the glossiness of the obtained color image was not satisfactory. In addition, the color development performance on an OHP film was poor.

COMPARATIVE EXAMPLE 2

[Preparation of Yellow Toner]

The following components were thoroughly mixed in a blender, kneaded under the application of heat thereto in a two-roll mill at 100° to 110° C., and then cooled to room temperature, whereby a kneaded lump was obtained:

| | Parts by Weight |
|---|---|
| Binder resin A (styrene/n-butyl methacrylate copolymer with a softening point of 113° C. and a peak molecular weight of 4.0 in terms of LogM) | 100 |
| Wax (ester wax: carnauba wax free of free aliphatic acids with a melting point of 83° C. Mw = 4600, M = 2700, and Mw/Mn = 1.70) | 5 |
| Disazo Yellow Pigment (C.I. Pigment Yellow 17) | 5 |
| Charge controlling agent (Zinc salt of salicylic acid derivative) | 2 |

The thus obtained lump was roughly ground in a cutter mill, and finely pulverized in a pulverizer using air jet. Then, the pulverized mixture was classified by an air classification apparatus, whereby yellow-colored matrix particles with a volume mean diameter of 7.7 μm were obtained. The volume mean diameter of the matrix particles was measured in the same manner as in Example 1.

Then, 100 parts by weight of the yellow-colored matrix particles and 0.5 parts by weight of hydrophobic silica were mixed in a Henschel mixer, whereby a comparative yellow toner was prepared.

[Preparation of Magenta Toner]

The above-mentioned procedure for preparation of the comparative yellow toner was repeated except that the coloring agent in the formulation of the yellow-colored matrix particles for the comparative yellow toner was replaced by a quinacridone magenta pigment (C.I. Pigment Red 122) in an amount of 4 parts by weight, whereby a comparative magenta toner was prepared.

The volume mean diameter of the comparative magenta-colored matrix particles was 7.3 μm.

[Preparation of Cyan Toner]

The above-mentioned procedure for preparation of the comparative yellow toner was repeated except that the coloring agent in the formulation of the yellow-colored matrix particles for the comparative yellow toner was replaced by a copper phthalocyanine blue pigment (C.I. Pigment Blue 15) in an amount of 2 parts by weight, whereby a comparative cyan toner was prepared.

The volume mean diameter of the cyan-colored matrix particles was 7.5 μm.

[Preparation of Black Toner]

The above-mentioned procedure for preparation of the comparative yellow toner was repeated except that the coloring agent in the formulation of the yellow-colored matrix particles for the comparative yellow toner was replaced by carbon black in an amount of 6 parts by weight, whereby a comparative black toner was prepared.

The volume mean diameter of the black-colored matrix particles was 7.6 μm.

Table 1 shows the composition of each of the above prepared comparative color toners.

[Preparation of Developers]

5 parts by weight of each comparative color toner were separately mixed with 100 parts by weight of ferrite carrier particles prepared by coating a silicone resin on the surface of ferrite core particles with an average particle size of 50 μm in a tumbler mixer, whereby comparative yellow, magenta, cyan and black developers were obtained.

The same evaluation tests as employed in Example 1 were conducted by setting the above obtained color developers in the commercially available color copying machine (Trademark "PRETER 550", made by Ricoh Company, Ltd.).

The results of the evaluation tests are shown in Table 2.

As a result, the offset-free image-fixing temperature range was too narrow for practical use, and the color development performance on an OHP film was not satisfactory.

COMPARATIVE EXAMPLE 3

[Preparation of Yellow Toner]

The following components were thoroughly mixed in a blender, kneaded under the application of heat thereto in a two-roll mill at 100° to 110° C., and then cooled to room temperature, whereby a kneaded lump was obtained:

| | Parts by Weight |
|---|---|
| Binder resin A (polyester resin with a softening point of 105° C. and a peak molecular weight of 3.7 in terms of LogM, obtained | 60 |

-continued

| | Parts by Weight |
|---|---|
| by polymerization of propylene oxide adduct of bisphenol A, terephthalic acid, and fumaric acid) | |
| Binder resin B (polyester resin with a softening point of 120° C. and a main peak of 4.1 in terms of the LogM, obtained by polymerization of ethylene oxide adduct of bisphenol A, propylene oxide adduct, terephthalic acid, succinic acid derivative, and trimellitic acid anhydride) | 40 |
| Wax (polypropylene wax with a melting point of 130° C. Mw = 8600, Mn = 2270, and Mw/Mn = 3.80) | 6 |
| Disazo Yellow Pigment (C.I. Pigment Yellow 17) | 5 |
| Charge controlling agent (Zinc salt of salicylic acid derivative) | 2 |

The thus obtained lump was roughly ground in a cutter mill, and finely pulverized in a pulverizer using air jet. Then, the pulverized mixture was classified by an air classification apparatus, whereby yellow-colored matrix particles with a volume mean diameter of 7.3 μm were obtained. The volume mean diameter of the matrix particles was measured in the same manner as in Example 1.

Then, 100 parts by weight of the yellow-colored matrix particles and 0.5 parts by weight of hydrophobic silica were mixed in a Henschel mixer, whereby a comparative yellow toner was prepared.

[Preparation of Magenta Toner]

The above-mentioned procedure for preparation of the comparative yellow toner was repeated except that the coloring agent in the formulation of the yellow-colored matrix particles for the comparative yellow toner was replaced by a quinacridone magenta pigment (C.I. Pigment Red 122) in an amount of 4 parts by weight, whereby a comparative magenta toner was prepared.

The volume mean diameter of the magenta-colored matrix particles was 7.4 μm.

[Preparation of Cyan Toner]

The above-mentioned procedure for preparation of the comparative yellow toner was repeated except that the coloring agent in the formulation of the yellow-colored matrix particles for the comparative yellow toner was replaced by a copper phthalocyanine blue pigment (C.I. Pigment Blue 15) in an amount of 2 parts by weight, whereby a comparative cyan toner was prepared.

The volume mean diameter of the cyan-colored matrix particles was 7.6 μm.

[Preparation of Black Toner]

The above-mentioned procedure for preparation of the comparative yellow toner was repeated except that the coloring agent in the formulation of the yellow-colored matrix particles for the comparative yellow toner was replaced by carbon black in an amount of 6 parts by weight, whereby a comparative black toner was prepared.

The volume mean diameter of the black-colored matrix particles was 7.5 μm.

Table 1 shows the composition of each of the above prepared comparative color toners.

[Preparation of Developers]

5 parts by weight of each comparative color toner were separately mixed with 100 parts by weight of ferrite carrier particles prepared by coating a silicone resin on the surface of ferrite core particles with an average particle size of 50 μm in a tumbler mixer, whereby comparative yellow, magenta, cyan and black developers were obtained.

The same evaluation tests as employed in Example 1 were conducted by setting the above obtained comparative color developers in the commercially available color copying machine (Trademark "PRETER 550", made by Ricoh Company, Ltd.).

The results of the evaluation tests are shown in Table 2.

As a result, the offset-free image-fixing temperature range was too narrow for practical use. In addition, it was impossible to measure the glossiness of the obtained image and evaluate the color development performance on an OHP film.

TABLE 1

| | Composition of Color Toner | | | | | | | | | | | |
|---|---|---|---|---|---|---|---|---|---|---|---|---|
| | | Binder Resin Composition | | | | | | | | | | |
| | | Binder Resin A | | | | Binder Resin B | | | | Wax | | |
| Ex. | Toner Color | Constituent Component | Softening Point (°C.) | Peak Molecular Weight (LogM) | Amount (Parts by weight) | Constituent Component | Softening Point (°C.) | Peak Molecular Weight (LogM) | Amount (Parts by weight) | Constituent Component | m.p. (°C.) | Mw Mn Mw/Mn |
| 1 | Black Yellow Magenta Cyan | Styrene-acrylic resin | 100 | 3.3 | 40 | Styrene-acrylic resin | 123 | 3.9 | 60 | Micro wax | 89 | 450 300 1.50 |
| 2 | Black Yellow Magenta Cyan | Styrene-acrylic resin | 100 | 4.4 | 30 | Styrene-acrylic resin | 123 | 3.9 | 70 | Para-ffin wax | 70 | 300 240 1.25 |

TABLE 1-continued

| | | Composition of Color Toner | | | | | | | | | | |
|---|---|---|---|---|---|---|---|---|---|---|---|---|
| | | Binder Resin Composition | | | | | | | | | | |
| | | Binder Resin A | | | | Binder Resin B | | | | Wax | | |
| Ex. | Toner Color | Constituent Component | Softening Point (°C.) | Peak Molecular Weight (LogM) | Amount (Parts by weight) | Constituent Component | Softening Point (°C.) | Peak Molecular Weight (LogM) | Amount (Parts by weight) | Constituent Component | m.p. (°C.) | Mw Mn Mw/Mn |
| 3 | Black Yellow Magenta Cyan | Polyol resin | 105 | 4.0 | 70 | Poly-ester resin | 120 | 4.1 | 30 | Ester wax | 83 | 4600 2700 1.70 |
| 4 | Black Yellow Magenta Cyan | Styrene-acrylic resin | 100 | 4.4 | 30 | Polyol resin | 115 | 3.8 | 70 | Para-ffin wax | 70 | 300 240 1.25 |
| 5 | Black Yellow Magenta Cyan | Poly-ester resin | 105 | 3.7 | 70 | Polyol resin | 115 | 3.9 | 30 | Ester wax | 80 | 4400 3800 1.16 |
| 6 | Black Yellow Magenta Cyan | Poly-ester resin | 105 | 3.7 | 60 | Poly-ester resin | 120 | 4.1 | 40 | Polyethylene wax | 80 | 542 517 1.05 |
| 1 | Black Yellow Magenta Cyan | Styrene-acrylic resin | 100 | 4.4 | 30 | Poly-ester resin | 139 | 4.1 | 70 | Para-ffin wax | 62 | 240 190 1.26 |
| 2 | Black Yellow Magenta Cyan | Styrene-acrylic resin | 113 | 4.0 | 100 | — | — | — | — | Ester wax | 83 | 4600 2700 1.70 |
| 3 | Black Yellow Magenta Cyan | Poly-ester resin | 105 | 3.7 | 60 | Poly-ester resin | 120 | 4.1 | 40 | Polyprop-ylene wax | 130 | 6600 2270 3.80 |

TABLE 2

| | Results of Evaluation Image Fixing Characteristics | | |
|---|---|---|---|
| | Offset-free Image Fixing | Temperature of Image Fixing Roller: 160° C. | |
| | Temperature Range (°C.) | Glossiness (%) | Haze (%) |
| Ex. 1 | 130–180 | 17 | 24 |
| Ex. 2 | 130–190 | 15 | 25 |
| Ex. 3 | 130–200 | 20 | 22 |
| Ex. 4 | 120–200 | 21 | 20 |
| Ex. 5 | 120–200 | 21 | 20 |
| Ex. 6 | 120–210 | 22 | 18 |
| Comp. Ex. 1 | 140–220 | 3 | 60 |
| Comp. Ex. 2 | 140–160 | 10 | 40 |
| Comp. Ex. 3 | 210–220 | Evaluation impossible | Evaluation impossible |

Japanese Patent Application No. 07-222708 filed Aug. 8, 1995, and Japanese Patent Application No. (not yet available) filed Aug. 2, 1996 are hereby incorporated by reference.

What is claimed is:

1. A color toner comprising:

a binder resin composition comprising a binder resin A with a softening point in the range of 85° to 110° C., and a binder resin B with a softening point in the range of 115° to 135° C., said binder resin A and said binder resin B being compatible with each other;

a coloring agent; and a wax with a melting point in the range of 65° to 90° C., which is not compatible with said binder resin composition and dispersed in said binder resin composition.

2. The color toner as claimed in claim 1, wherein each of said binder resin A and said binder resin B has a main peak in the range of 3.5 and 4.5 in terms of the logarithmic molecular weight LogM thereof in the respective molecular weight distribution.

3. The color toner as claimed in claim 1, wherein each of said binder resin A and said binder resin B comprises a polyester resin or a polyol resin.

4. The color toner as claimed in claim 2, wherein each of said binder resin A and said binder resin B comprises a polyester resin or a polyol resin.

5. The color toner as claimed in claim 3, wherein said polyester resin is a polyester resin obtained by condensation polymerization of:

(a) a diol component of formula (I):

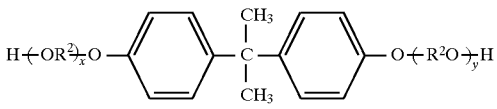

(I)

wherein $R^1$ is an alkylene group having 2 to 4 carbon atoms; and x and y represent a positive integer, with the total sum of x and y having an average value of 2 to 16; and (b) at least one acid component selected from the group consisting of:

(1) a dicarboxylic acid represented by formula (II)

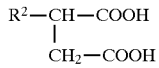

(II)

wherein $R^2$ is a saturated or unsaturated hydrocarbon group having 4 to 20 carbon atoms;

(2) an anhydride of said dicarboxylic acid of formula (II);

(3) a lower alkyl ester of said dicarboxylic acid of formula (II);

(4) a dicarboxylic acid represented by formula (III)

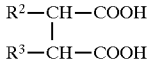

(III)

wherein $R^2$ and $R^3$ are a saturated or unsaturated hydrocarbon group having 4 to 20 carbon atoms;

(5) an anhydride of said dicarboxylic acid of formula (III);

(6) a lower alkyl ester of said dicarboxylic acid of formula (III);

(7) an aromatic polycarboxylic acid represented by formula (IV):

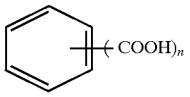

(IV)

wherein n is an integer of 2 to 3;

(8) a lower alkyl ester of said aromatic polycarboxylic acid of formula (IV); and (9) an anhydride of said aromatic polycarboxylic acid of formula (IV).

6. The color toner as claimed in claim 5, wherein said aromatic polycarboxylic acid of formula (IV) is trimellitic acid.

7. The color toner as claimed in claim 5, wherein said anhydride of said aromatic polycarboxylic acid of formula (IV) is trimellitic acid anhydride.

8. The color toner as claimed in claim 5, further comprising, as an additional acid component for said condensation polymerization, at least one additional acid component selected from the group consisting of an aromatic polycarboxylic acid represented by formula (V):

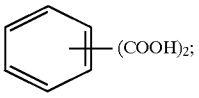

(V)

an anhydride of said aromatic polycarboxylic acid; and a lower alkyl ester of said aromatic polycarboxylic acid.

9. The color toner as claimed in claim 4, wherein said polyester resin is a polyester resin obtained by condensation polymerization of:

(a) a diol component of formula (I):

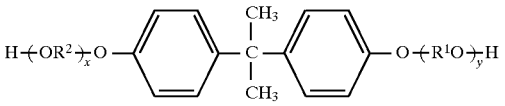

(I)

wherein $R^1$ is an alkylene group having 2 to 4 carbon atoms; and x and y represent a positive integer, with the total sum of x and y having an average value of 2 to 16; and (b) at least one acid component selected from the group consisting of:

(1) a dicarboxylic acid represented by formula (II)

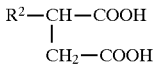

(II)

wherein $R^2$ is a saturated or unsaturated hydrocarbon group having 4 to 20 carbon atoms;

(2) an anhydride of said dicarboxylic acid of formula (II);

(3) a lower alkyl ester of said dicarboxylic acid of formula (II);

(4) a dicarboxylic acid represented by formula (III)

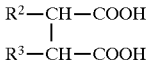

(III)

wherein $R^2$ and $R^3$ are a saturated or unsaturated hydrocarbon group having 4 to 20 carbons atoms;

(5) an anhydride of said dicarboxylic acid of formula (III);

(6) a lower alkyl ester of said dicarboxylic acid of formula (III);

(7) an aromatic polycarboxylic acid represented by formula (IV):

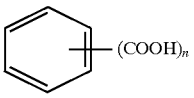

(IV)

wherein n is an integer of 2 to 3;

(8) a lower alkyl ester of said aromatic polycarboxylic acid of formula (IV); and (9) an anhydride of said aromatic polycarboxylic acid of formula (IV).

10. The color toner as claimed in claim 9, wherein said aromatic polycarboxylic acid of formula (IV) is trimellitic acid.

11. The color toner as claimed in claim 9, wherein said anhydride of said aromatic polycarboxylic acid represented by formula (IV) is trimellitic acid anhydride.

12. The color toner as claimed in claim 9, further comprising, as an additional acid component for said condensation polymerization, at least one additional acid component selected from the group consisting of an aromatic polycarboxylic acid represented by formula (V):

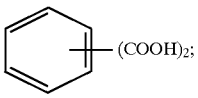

(V)

an anhydride of said aromatic polycarboxylic acid; and a lower alkyl ester of said aromatic polycarboxylic acid.

13. The color toner as claimed in claim 1, wherein said wax ha a Mw/Mn ratio of 1.0 to 1.2.

14. The color toner as claimed in claim 1, wherein said wax is selected from the group consisting of an ester wax and an olefin wax.

15. The color toner as claimed in claim 13, wherein said wax is selected from the group consisting of an ester wax and an olefin wax.

* * * * *

UNITED STATES PATENT AND TRADEMARK OFFICE

CERTIFICATE OF CORRECTION

PATENT NO. : 5,840,456
DATED : November 24, 1998
INVENTOR(S) : Masami Tomita et al.

It is certified that error appears in the above-identified patent and that said Letters Patent is hereby corrected as shown below:

Column 7,
Line 36, “alky” should read -- alkyl --.

Column 9,
Line 27, “occurs” should read -- occur --.

Column 15,
Line 22, “tumbling” should read -- tumbler --.

Columns 27 and 28,
Example 5, “3.9” should read -- 3.8 --.

Column 28,
Line 60, “ 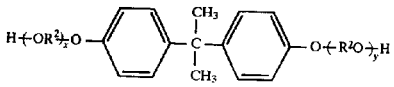 (I) ”

should read -- 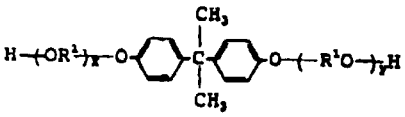 --.

Column 29,
Line 60, “ 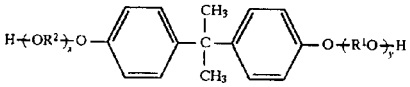 (I) ”

should read -- 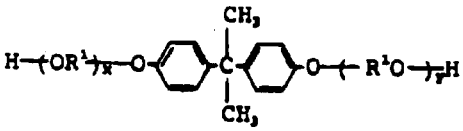 --.

UNITED STATES PATENT AND TRADEMARK OFFICE

CERTIFICATE OF CORRECTION

PATENT NO. : 5,840,456
DATED : November 24, 1998
INVENTOR(S) : Masami Tomita et al.

It is certified that error appears in the above-identified patent and that said Letters Patent is hereby corrected as shown below:

Column 30,
Line 57, "ha" should read -- has --.

Signed and Sealed this

Fifth Day of November, 2002

*Attest:*

*Attesting Officer*

JAMES E. ROGAN
*Director of the United States Patent and Trademark Office*